US008215765B2

(12) United States Patent
Murase

(10) Patent No.: US 8,215,765 B2
(45) Date of Patent: Jul. 10, 2012

(54) INK JET RECORDING APPARATUS

(75) Inventor: Tetsuya Murase, Chiba (JP)

(73) Assignee: Seiko I Infotech Inc. (JP)

( * ) Notice: Subject to any disclaimer, the term of this patent is extended or adjusted under 35 U.S.C. 154(b) by 1572 days.

(21) Appl. No.: 11/650,792

(22) Filed: Jan. 8, 2007

(65) Prior Publication Data

US 2007/0171269 A1 Jul. 26, 2007

(30) Foreign Application Priority Data

Jan. 25, 2006 (JP) ..... 2006-016706

(51) Int. Cl.
*B41J 29/13* (2006.01)

(52) U.S. Cl. ..... 347/108

(58) Field of Classification Search ..... None
See application file for complete search history.

(56) References Cited

U.S. PATENT DOCUMENTS

| | | | |
|---|---|---|---|
| 2,483,843 A | 10/1949 | Prezioso | |
| 6,394,568 B1 | 5/2002 | Menendez | |
| 2003/0039500 A1 | 2/2003 | Kelley et al. | |
| 2004/0119808 A1 | 6/2004 | Mori | 347/220 |

FOREIGN PATENT DOCUMENTS

| | | |
|---|---|---|
| DE | 430487 | 6/1926 |
| DE | 3524049 | 1/1987 |
| JP | 60040284 | 3/1985 |
| JP | 06070107 | 3/1994 |
| JP | 9152662 | 6/1997 |
| JP | 2000141800 | 5/2000 |
| JP | 2000141800 A * | 5/2000 |
| JP | 2001310525 | 11/2001 |
| JP | 2001315408 | 11/2001 |
| JP | 2003316096 | 11/2003 |
| JP | 2004195805 | 7/2004 |
| JP | 2004287019 | 10/2004 |

* cited by examiner

*Primary Examiner* — Matthew Luu
*Assistant Examiner* — Kendrick Liu
(74) *Attorney, Agent, or Firm* — Adams & Wilks

(57) ABSTRACT

To print an excellent image formed without distortion or image failure by mitigating irregularities, inclination, or the like of an installation floor surface. In an ink jet recording apparatus including an ink jet recording apparatus main body and a leg portion, a deformation absorbing member is interposed in a joint portion between the ink jet recording apparatus main body and the leg portion. Therefore, even if there are the irregularities, the inclination, or the like on a floor surface to which the ink jet recording apparatus is installed, it is possible to ensure leveling of a print surface in the ink jet recording apparatus main body, thereby being capable of obtaining the excellent image without the distortion or the image failure.

5 Claims, 11 Drawing Sheets

INK JET RECORDING APPARATUS

BACKGROUND OF THE INVENTION

1. Field of the Invention

The present invention relates to an ink jet recording apparatus supported by a leg portion, and more particularly, to a large-size ink jet recording apparatus and a method of assembling the ink jet recording apparatus.

2. Description of the Related Art

In recent years, ink jet recording apparatuses are widely used as recording terminals for printers, word processors, personal computers, and the like to obtain colorful prints and to reduce noise in recording. In many cases, a floor surface of a place where the ink jet recording apparatus is installed is not a completely level surface and has microscopic irregularities. When the ink jet recording apparatus is installed on such a floor surface with irregularities, variations occur among reaction forces received by leg portions of the ink jet recording apparatus from the floor surface. Therefore, torsion or distortion is generated with respect to a casing, thereby causing a state where leveling of a print surface (platen) cannot be ensured.

When an image formation is performed in such a state, there is a fear of leading to a reduction in image quality such as color drift. Thus, there are proposed various means for preventing the distortion of the casing due to the irregularities of the installation floor surface. For example, JP 06-70107 A discloses that three leg portions are provided, for substantially receiving a load of an image forming apparatus while abutting a floor surface, thereby preventing distortion of a casing.

JP 06-70107 A discloses that screw-shaped short leg portions are fixed to a bottom portion of the image forming apparatus having a casing shape, and lengths of the leg portions are adjusted so that base end portions of the leg portions are set to be level with one another. However, it is considerably difficult to adjust the lengths of the leg portions such that the base end portions of the leg portions are level with one another. In fact, no matter how the lengths are adjusted, torsion or distortion remains on the casing.

SUMMARY OF THE INVENTION

The present invention has been made in view of the above-mentioned problem. It is therefore an object of the present invention to provide an ink jet recording apparatus and a method of assembling the ink jet recording apparatus in which deformation absorbing members are interposed in joint portions between an ink jet recording apparatus main body and a leg portion, thereby making it possible to mitigate effects of irregularities, inclination, and the like on an installation floor surface, to obtain an excellent image formed without distortion or image failure.

To achieve the object described above, according to the present invention, an ink jet recording apparatus, including: an ink jet recording apparatus main body; and a leg portion, is characterized in that a deformation absorbing member is interposed in a joint portion between the ink jet recording apparatus main body and the leg portion.

Further, according to one aspect of the present invention, the deformation absorbing member includes: a rectangular board portion to be fixed to one of the ink jet recording apparatus main body and the leg portion; and flexible cut and raised portions, each of which is cut and raised from each of four corners of the board portion and has an L-shaped cross section, to be fixed to another of the ink jet recording apparatus main body and the leg portion.

Further, according to another aspect of the present invention, the deformation absorbing member includes: a first board member to be fixed to a side of the leg portion; a second board member to be fixed to a side of the ink jet recording apparatus main body; and a plurality of spring members arranged between the first board member and the second board member; and the first board member and the second board member are arranged such that an interval between each other can be modified.

Further, according to a further aspect of the present invention, the deformation absorbing member includes: a rectangular board portion to be fixed to one of the ink jet recording apparatus main body and the leg portion; and flexible step portions, each having an L-shaped cross section and being formed in a step shape by bending each of ends on right and left of the board portion, to be fixed to another of the ink jet recording apparatus main body and the leg portion.

Further, according to the present invention, it is characterized in that the deformation absorbing member has a positioning pin on a surface opposed to the ink jet recording apparatus main body.

Further, according to the present invention, the deformation absorbing member may employ a spring member formed of SUS 301, SUS 303, or the like.

Further, according to the present invention, a method of assembling an ink jet recording apparatus including: an ink jet recording apparatus main body; and a leg portion, is characterized by assembling with a deformation absorbing member being interposed in a joint portion between the ink jet recording apparatus main body and the leg portion.

According to the present invention, in the ink jet recording apparatus including the ink jet recording apparatus main body and the leg portion, the deformation absorbing members are interposed in the joint portions between the ink jet recording apparatus main body and the leg portion. Therefore, the deformation absorbing members mitigate effects of irregularities, inclination, and the like of the installation floor surface to level the bottom surface of the ink jet recording apparatus main body, and thus, leveling of the print surface in the ink jet recording apparatus main body is ensured, thereby making it possible to print an excellent image without image distortion or image failure. Further, in a manufacturing process, even in a case where the ink jet recording apparatus main body, which is manufactured on a dedicated jig and is packed separately from the leg portion to be shipped, is assembled with the leg portion at a customer site, there occurs no variation in leveling of the print surface due to differences in level among leg portions.

Further, according to the present invention, the deformation absorbing member is composed of a rectangular board portion to be fixed to a leg portion side and flexible cut and raised portions, each having an L-shaped cross section, cut and raised from four corners, respectively, of the board portion. Therefore, the flexible cut and raised portions each having the L-shaped cross section absorb irregularities, inclination, and the like of the installation floor surface, thereby leveling a bottom surface of the ink jet recording apparatus main body. As a result, leveling of the print surface in the ink jet recording apparatus main body is ensured, making it possible to print the excellent image without image distortion or image failure.

Further, according to the present invention, the deformation absorbing member may be composed of a first board member to be fixed to the leg portion side, a second board member to be fixed to the ink jet recording apparatus main body side, and a plurality of spring members arranged between the first board member and the second board member. The first board member and the second board member are arranged such that an interval therebetween can be modified. Accordingly, the plurality of spring members mitigate effects of irregularities, inclination, and the like of the installation floor surface to ensure the leveling of the print surface in the ink jet recording apparatus main body, thereby making it possible to print the excellent image without image distortion or image failure.

According to the present invention, the deformation absorbing member may be composed of a rectangular board portion to be fixed to the leg portion side and flexible step portions, each having an L-shaped cross section and formed in a step shape by bending each of ends on the right and left of the board portion, to be fixed to the ink jet recording apparatus main body side. Accordingly, the flexible step portions each having the L shaped cross section absorb irregularities, inclination, or the like of the installation floor surface to ensure the leveling of the print surface in the ink jet recording apparatus main body, thereby making it possible to print the excellent image without image distortion or image failure.

Further, according to the present invention, the deformation absorbing member includes positioning pins on a surface to be opposed to the ink jet recording apparatus main body. Therefore, at the time of assembly, it is possible to accurately set positions of the apparatus main body and the leg portion to be assembled.

Further, according to the present invention, in a method of assembling the ink jet recording apparatus including the ink jet recording apparatus main body and the leg portion, the deformation absorbing member is interposed in the joint portion between the ink jet recording apparatus main body and the leg portion to be assembled, so even if the apparatus main body and the leg portion are separately shipped and assembled at a customer site, it is possible to ensure the leveling of the print surface without performing adjustment for each product by employing a leveler or the like. Accordingly, products can be shipped in a small package, thereby making it possible to reduce transportation cost.

DETAILED DESCRIPTION OF THE PREFERRED EMBODIMENTS

First Embodiment

Figure 1:
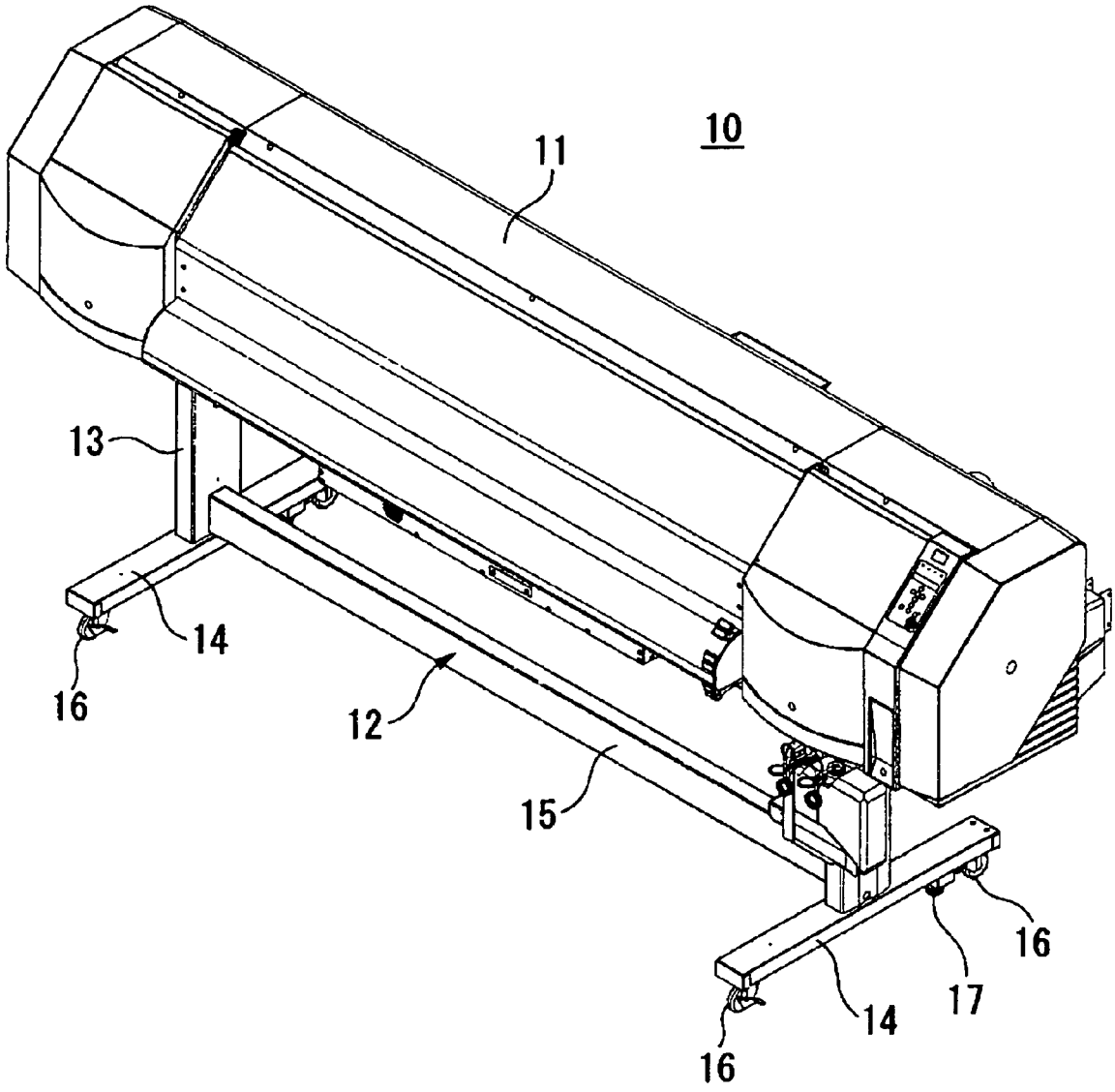
FIG. 1 is a perspective view showing an overall structure of an ink jet recording apparatus according to a first embodiment of the present invention.
Figure 2:
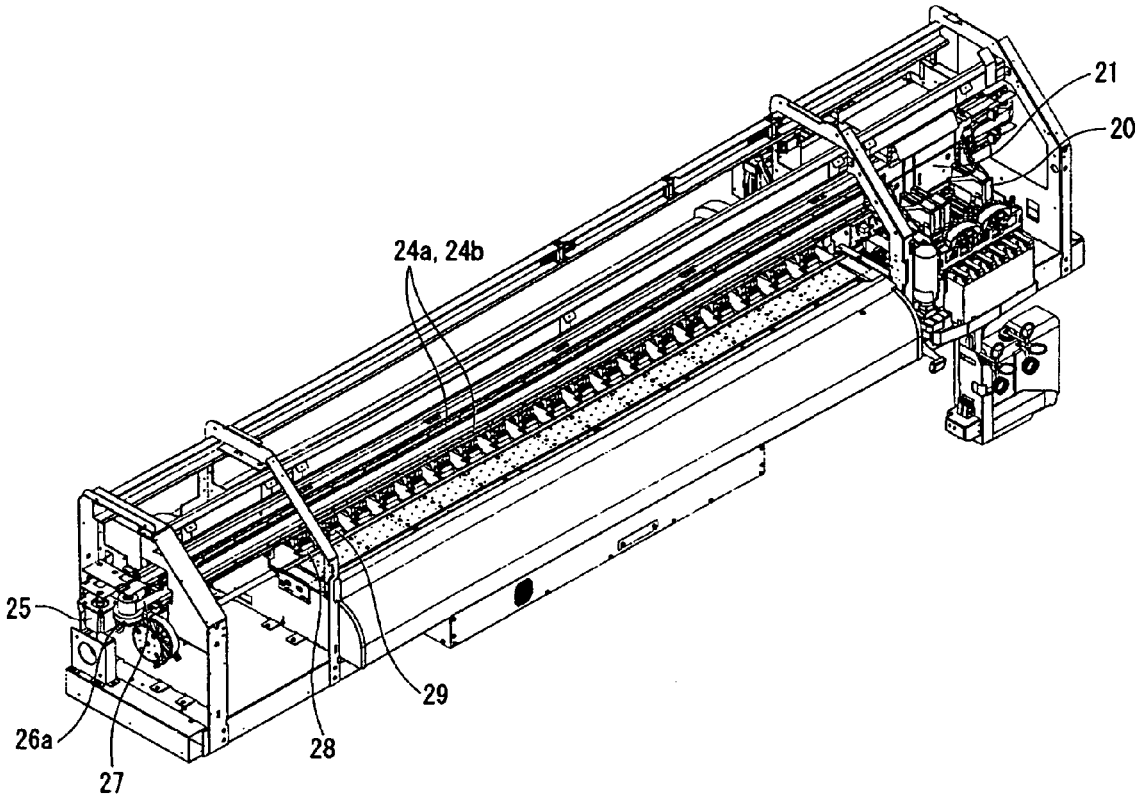
FIG. 2 is a perspective view of a main portion showing an inner structure of the ink jet recording apparatus viewed from a front portion thereof.
Figure 3:
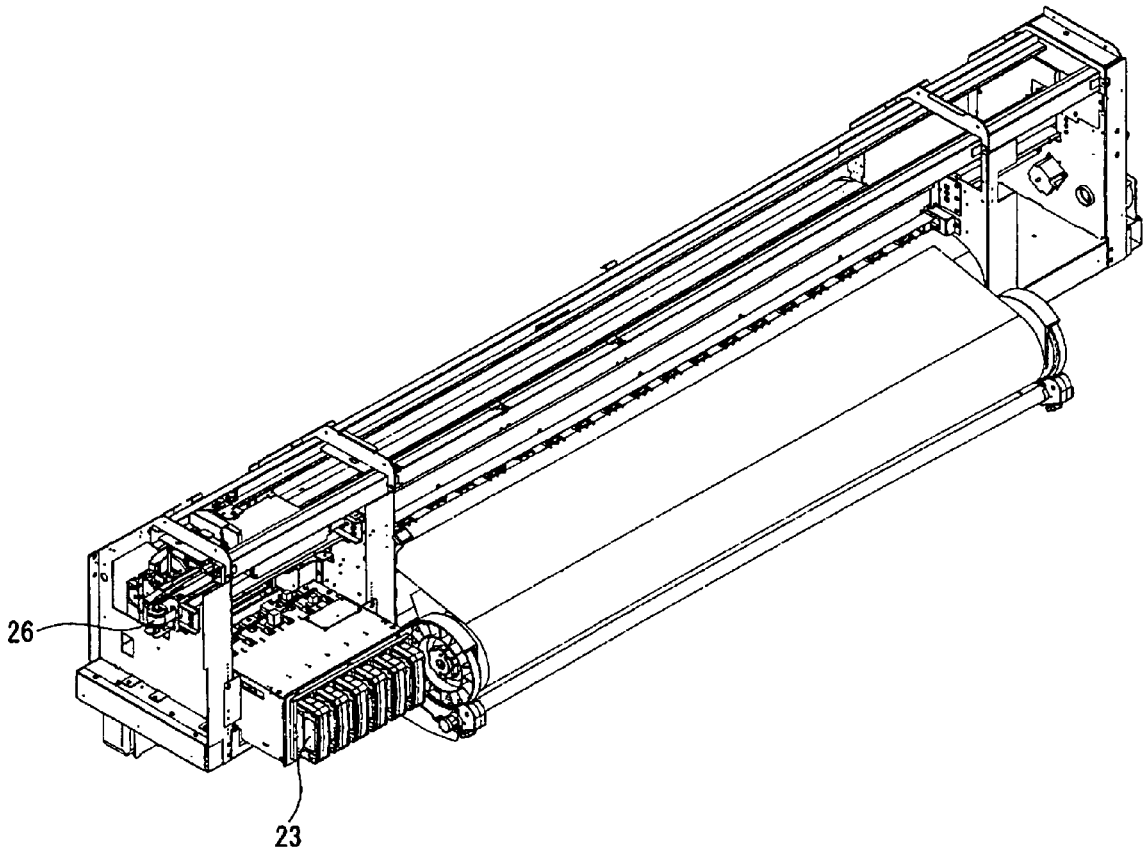
FIG. 3 is a perspective view of a main portion showing an inner structure of the ink jet recording apparatus viewed from a rear portion thereof.
Figure 4:
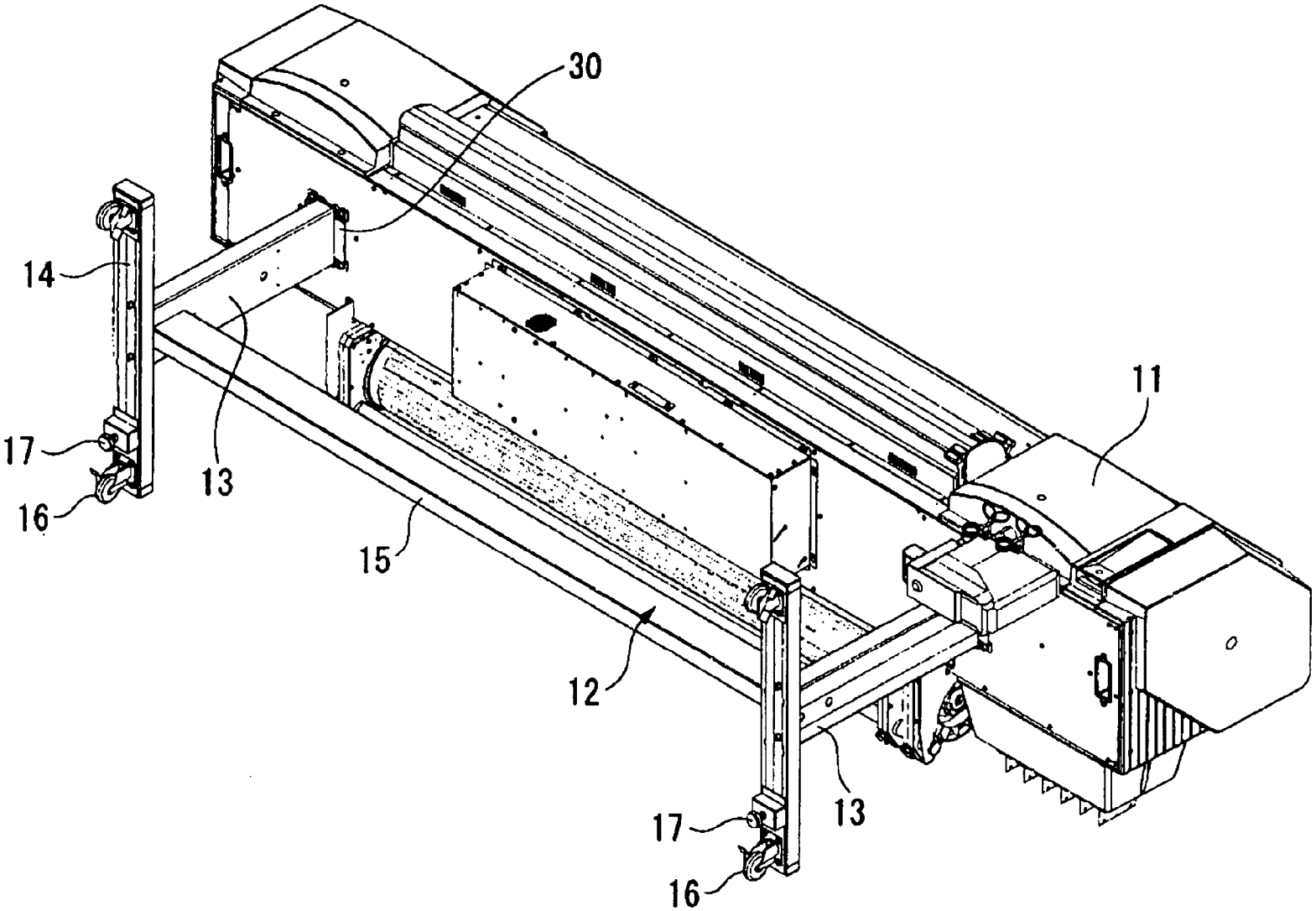
FIG. 4 is a perspective view of the ink jet recording apparatus viewed from a bottom thereof.
Figure 5:
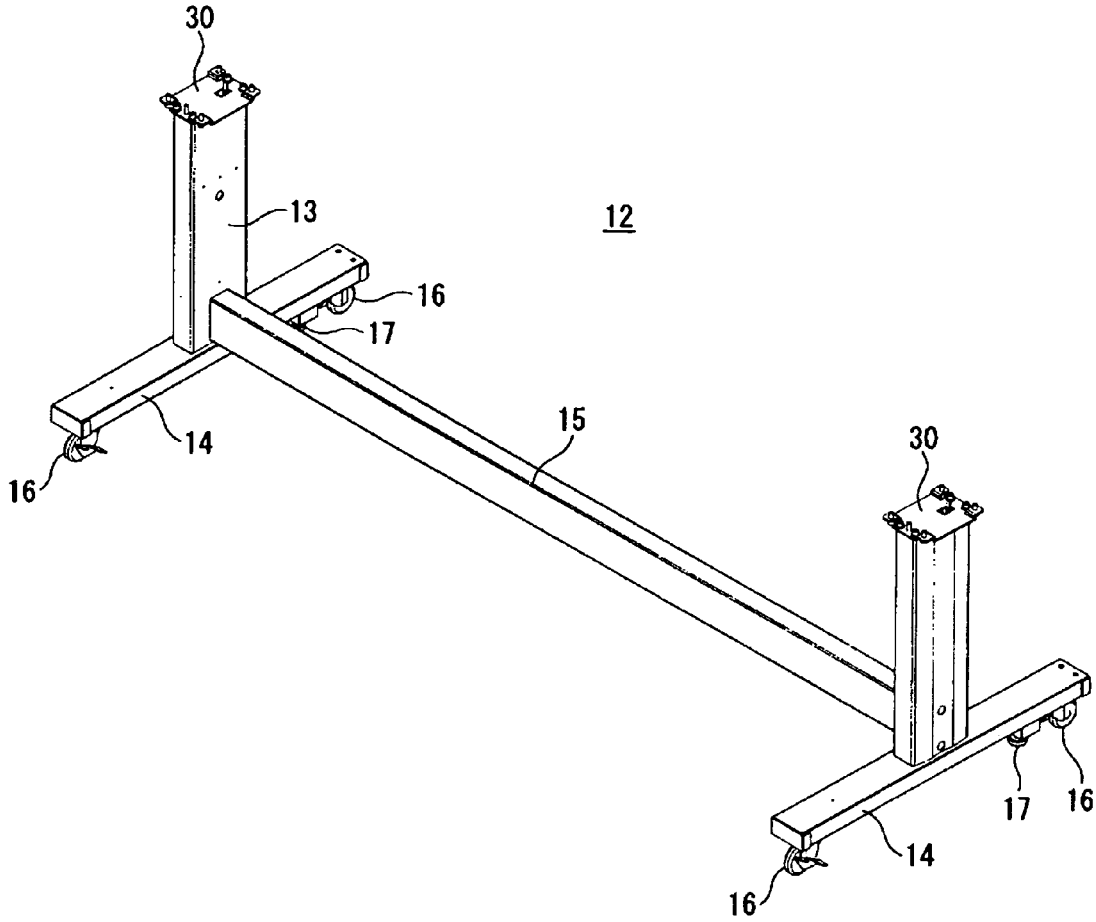
FIG. 5 is a perspective view showing a leg portion of the ink jet recording apparatus.

Hereinafter, the present invention will be described with reference to figures showing a first embodiment of the present invention. FIG. 1 is a perspective view showing an overall structure of an ink jet recording apparatus according to the present invention. FIGS. 2 and 3 each is a perspective view of a main portion showing an inner structure of the ink jet recording apparatus. FIG. 4 is a perspective view viewed from a bottom of the ink jet recording apparatus. FIG. 5 is a perspective view showing a leg portion. Here, an ink jet recording apparatus 10 is composed of an ink jet recording apparatus main body 11 and a leg portion 12 for horizontally supporting the ink jet recording apparatus main body 11. The leg portion 12 is composed of two support portions 13 arranged substantially vertically at a predetermined interval, lateral pole portions 14 arranged to be perpendicular to the support portions, respectively, a lateral beam portion 15 connecting the two support portions 13 to each other, casters 16 and adjust bolts 17 mounted on a lower surface of the lateral pole portions 14, and the like.

FIGS. 2 and 3 are each a perspective view of a main portion showing an inner structure of the ink jet recording apparatus 10. As shown in the figures, the ink jet recording apparatus 10 of this embodiment includes a plurality of ink jet heads 20 provided for each color, a carriage 21 having the ink jet heads 20 mounted in parallel with each other in a main scanning direction, and an ink cartridge 23 for supplying ink through an ink supply pipe (not shown) formed of a flexible tube. The carriage 21 is mounted so as to be movable in a longitudinal axis direction of a pair of guide rails 24*a* and 24*b*. Further, an end side of the guide rails 24*a* and 24*b* is provided with a drive motor 25. A driving force generated by the drive motor 25 is transmitted to a SUS belt 27 looped around a pulley 26*a* connected to the drive motor 25 and a pulley 26*b* provided on the other side of the guide rails 24*a* and 24*b*. As a result, the carriage 21 fixed in a predetermined position on the SUS belt 27 is conveyed.

Further, in a direction perpendicular to a conveying direction of the carriage 21, as transport means, a pair of transport rollers 28 and 29 are provided along a direction of the guide rails 24*a* and 24*b*. The transport rollers 28 and 29 serve for transporting a medium to which recording is effected toward a lower portion of the carriage 21 in the direction perpendicular to the conveying direction of the carriage 21.

The transport rollers 28 and 29 transport the medium to which the recording is effected while the carriage 21 is scanned in a direction perpendicular to a transport direction, whereby the ink jet head 20 prints an image or the like.

Figure 6:
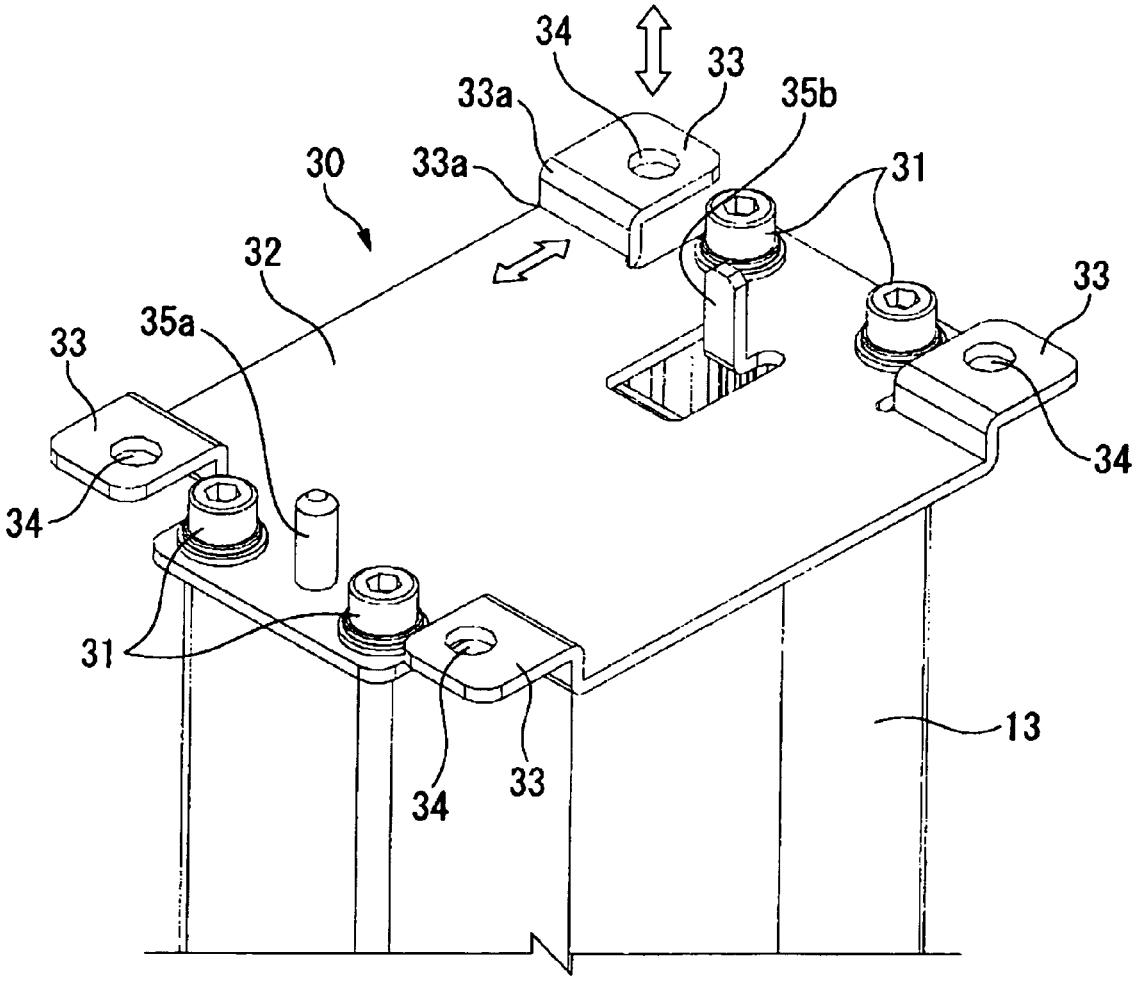
FIG. 6 is an enlarged perspective view showing a joint portion of the leg portion.
Figure 7:
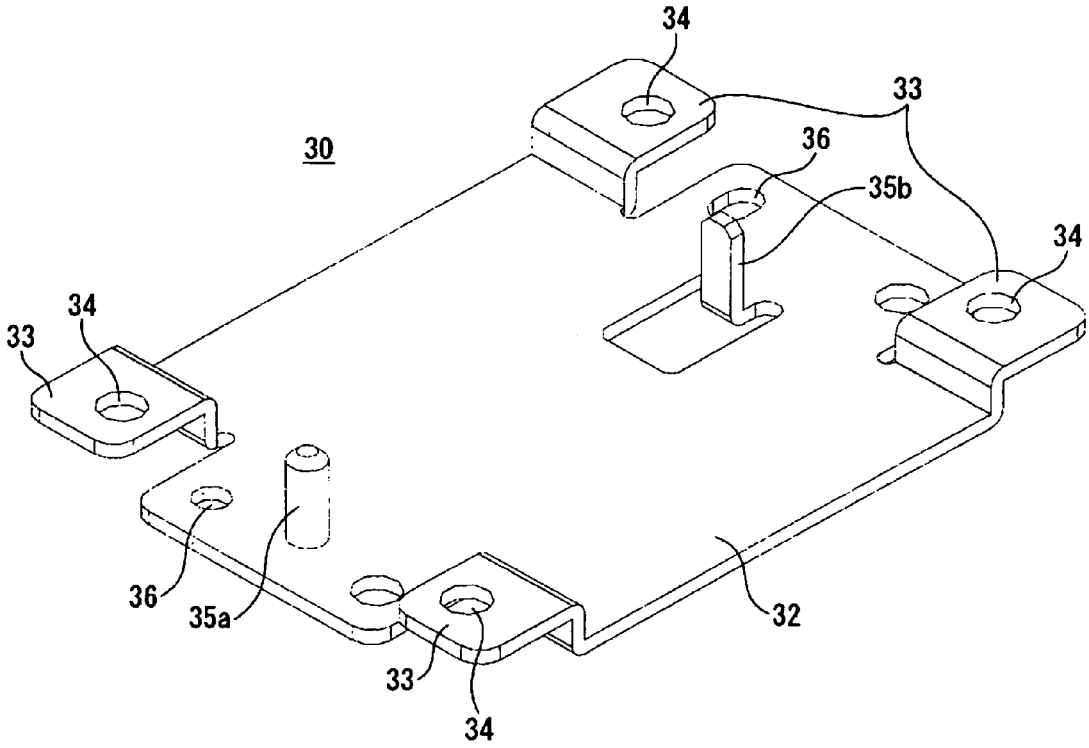
FIG. 7 is an enlarged perspective view showing a deformation absorbing member used for the joint portion.

Further, to each of the joint portions between the ink jet recording apparatus main body 11 and the leg portion 12, that is, top portions of the support portions 13, a deformation (deformable) absorbing member 30 is fixed by bolts 31 as shown in FIG. 6. The deformation absorbing member 30 is produced by effecting working with respect to a plate-like spring member formed of SUS 301, SUS 303, SECC, or the like, and, as shown in FIG. 7, is composed of a rectangular board or plate portion 32 to be fixed by bolts 31 to the support portion 13 of the leg portion and flexible cut and raised portions 33, each of which is cut and raised from each of four corners of the board portion 32 and has an L-shaped cross section, to be fixed to the ink jet recording apparatus main body 11 side. The board portion 32 has positioning pins 35*a* and 35*b*, which are provided upright on an upper surface of the board portion 32 to be opposed to the ink jet recording apparatus main body 11, and bolt holes 36 for fixation to the support portion 13. The positioning pin 35*a* is a columnar rigid pin. The positioning pin 35*b* is an elastic pin cut and raised from the board portion 32. The flexible cut, and raised portion 33 having the L-shaped cross section is bent so as to have a predetermined step and formed such that an upper surface portion thereof is in parallel with the board portion 32. Further, in the upper surface portion of the flexible cut and raised portion 33, there is formed a bolt hole 34 for fixation to the ink jet recording apparatus main body 11.

Next, a process of assembling the ink jet recording apparatus main body 11 and the leg portion 12 of the ink jet recording apparatus 10 structured as described above will be described. First, the deformation absorbing members 30 are fixed to the two support portions 13 of the leg portion 12 with the bolts 31 (refer to FIGS. 5 and 6). Next, while being guided by the positioning pins 35*a* and 35*b*, the ink jet recording apparatus main body 11 is placed in a predetermined position on the deformation absorbing members 30 fixed to the support portions 13. The bolts are allowed to pass through the bolt holes 34 in the flexible cut and raised portions 33 each having the L-shaped cross section to fix the ink jet recording apparatus main body 11 to the deformation absorbing members 30. As described above, the ink jet recording apparatus main body 11 and the leg portion 12 are attached to each other through the eight flexible cut and raised portions 33 each having the L-shaped cross section provided on the deformation absorbing members 30 on the left and right. Accordingly, even if the installation floor surface has irregularities, the flexible cut and raised portions 33 each having the L-shaped cross section absorb the irregularities, thereby ensuring the leveling of the print surface in the ink jet recording apparatus main body. The eight flexible cut and raised portions 33 each have the L-shaped cross section and are cut and raised from the board portions 32 to have a small width and a small rigidity. Two bent portions 33*a* and 33*a* are formed on the board portion 32 in such a manner that, as indicated by double-headed arrows in FIG. 6, both of the bent portions are apt to be bent in thickness directions of the board portion. Therefore, the flexible cut and raised portion 33 having the L-shaped cross section has a high degree of flexibility in deformability. Accordingly, the flexible cut and raised portions 33 deform appropriately as circumstances demand to absorb irregularities of the installation floor surface. As a result, it is possible to print the excellent image without image distortion or image failure.

Second Embodiment

Figure 8:
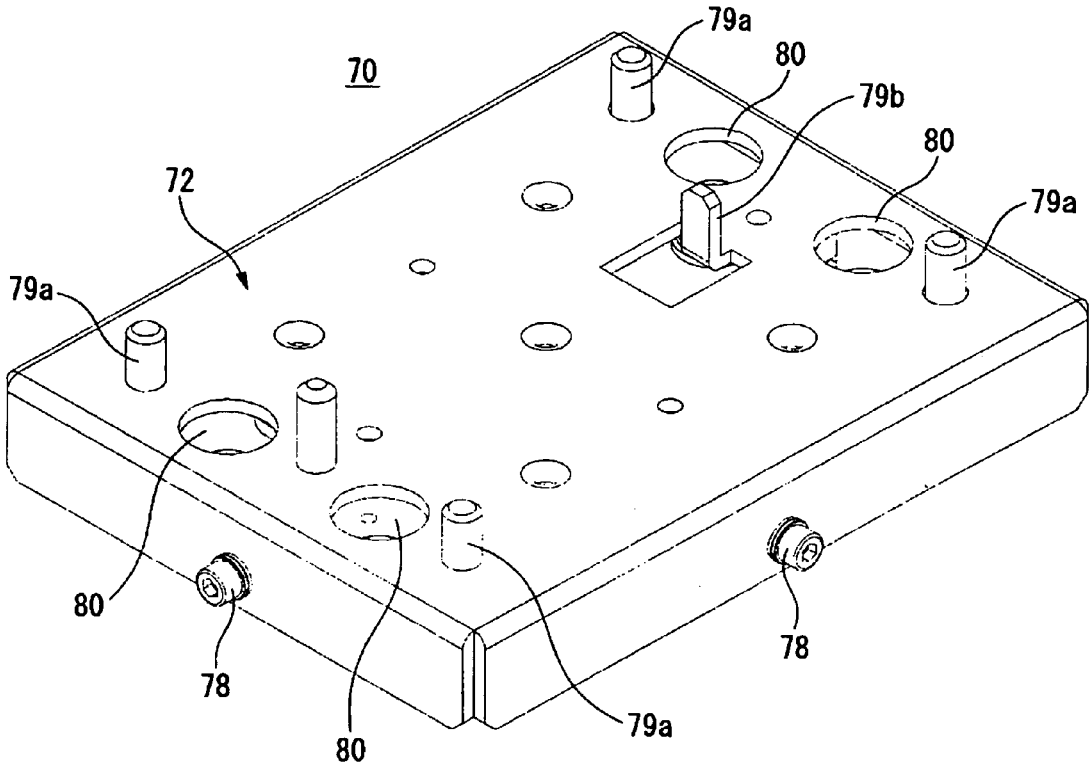
FIG. 8 is an enlarged perspective view of a main portion of an ink jet recording apparatus according to a second embodiment of the present invention.
Figure 9:
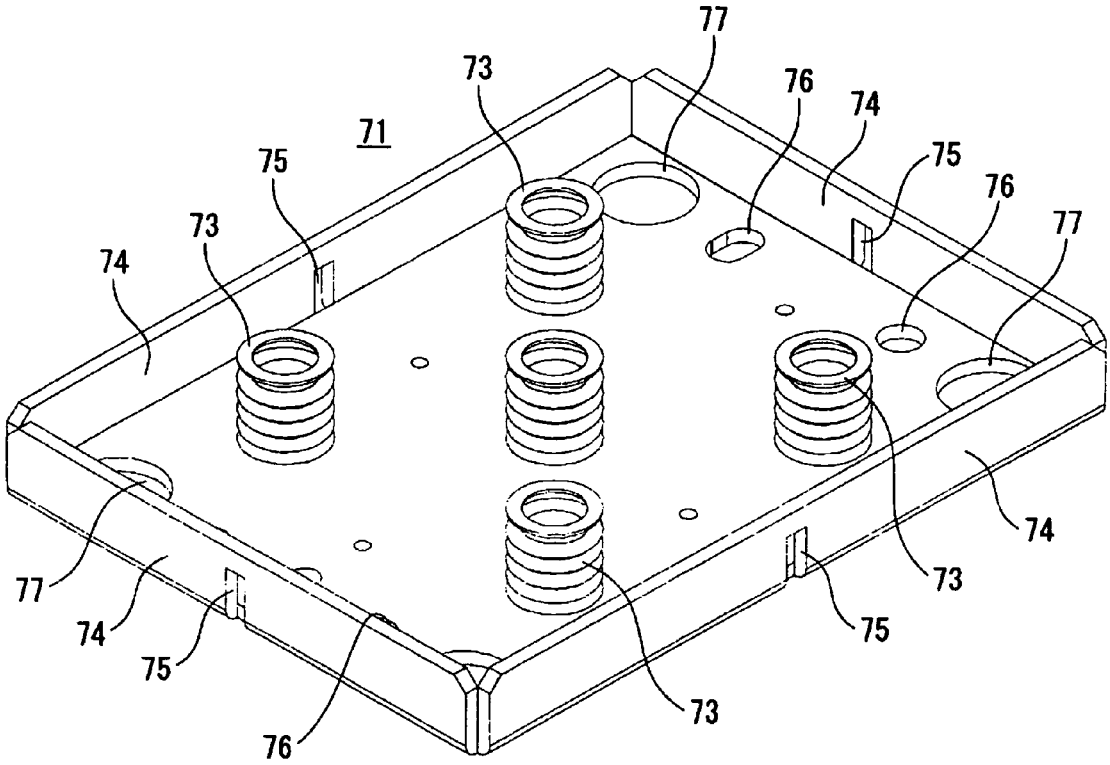
FIG. 9 is a perspective view showing a first board member used for a deformation absorbing member shown in FIG. 8.

FIG. 8 is an enlarged perspective view showing a deformation absorbing member according to a second embodiment of the present invention. FIG. 9 is a perspective view showing a first board member used for the deformation absorbing member. In this embodiment, a deformation absorbing member 70 is composed of a first board member 71 to be fixed to the leg portion side, a second board member 72 to be fixed to the apparatus main body side, and a plurality of spring members 73 arranged between the first board member 71 and the second board member 72. The first board member 71 assumes a box shape having an open upper surface and has side walls 74 each provided with a long hole 75 formed about a central lower portion thereof, for regulating strokes. Further, the first board member 71 has bolt holes 76 for fixation to the support portion 13 and operation holes 77 through which heads of bolts can pass. According to this embodiment, the spring member 73 is a compression coil spring having a spring constant such that it is possible to support the ink jet recording apparatus main body 11 by a plurality of spring members 73.

The second board member 72 assumes a box shape having an open lower surface and has side walls each having a bolt 78 threaded about a central portion thereof, for regulating strokes. Tips of the bolts 78 are loosely inserted into the long holes 75 of the first board member 71, respectively. On an upper surface of the second board member 72, positioning pins 79*a* and 79*b* are provided upright. Further, the second board member 72 is provided with operation holes 80, through which heads of bolts can pass, formed in the vicinity of the positioning pins 79*a* and 79*b*. The first board member 71 and the second board member 72 constructed as described above, engage with each other while being supported by the spring members 73, and strokes are regulated by means of the long holes 75 and the bolts 78. Accordingly, an interval between the board members can be modified within a predetermined range.

Third Embodiment

Figure 10:
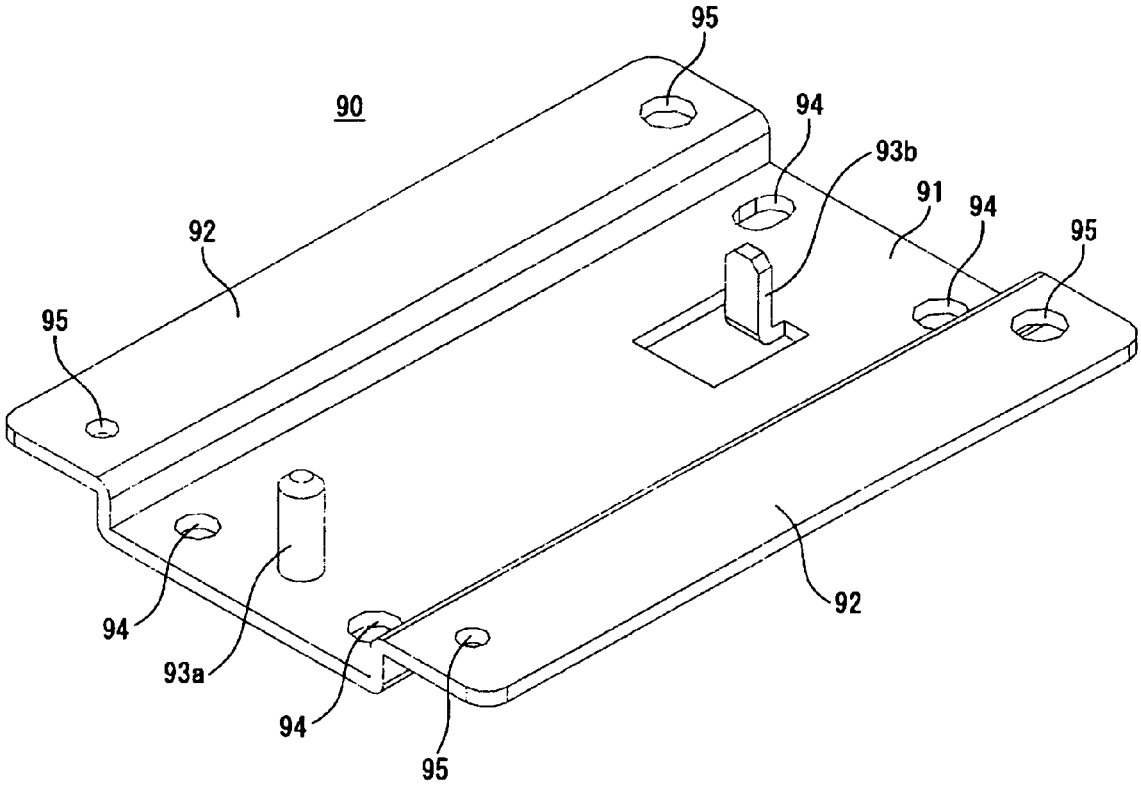
FIG. 10 is an enlarged perspective view of a main portion of an ink jet recording apparatus according to a third embodiment of the present invention.

FIG. 10 is an enlarged perspective view showing a deformation absorbing member according to a third embodiment of the present invention. In this embodiment, a deformation absorbing member 90 is composed of a rectangular board portion 91 to be fixed to the leg portion side, and flexible step portions 92, each having an L-shaped cross section and formed in a step shape by bending each of ends on the right and left of the board portion, to be fixed to the ink jet recording apparatus main body side. The board portion 91 is provided with positioning pins 93*a* and 93*b* formed upright on an upper surface thereof and bolt holes 94 formed therein, for fixation to the support portions 13. The positioning pin 93*a* is a columnar rigid pin. The positioning pin 93*b* is an elastic pin cut and raised form the board portion 91. The flexible step portion 92 having the L-shaped cross section is bent at each of the ends on the right and left of the board portion 91 so as to have a predetermined step and formed such that an upper surface portion thereof is in parallel with the board portion 91. Further, in the upper surface portion of the flexible step portion 92 having the L-shaped cross section, there is formed bolt holes 95 for fixation to the ink jet recording apparatus main body 11.

Fourth Embodiment

Figure 11:
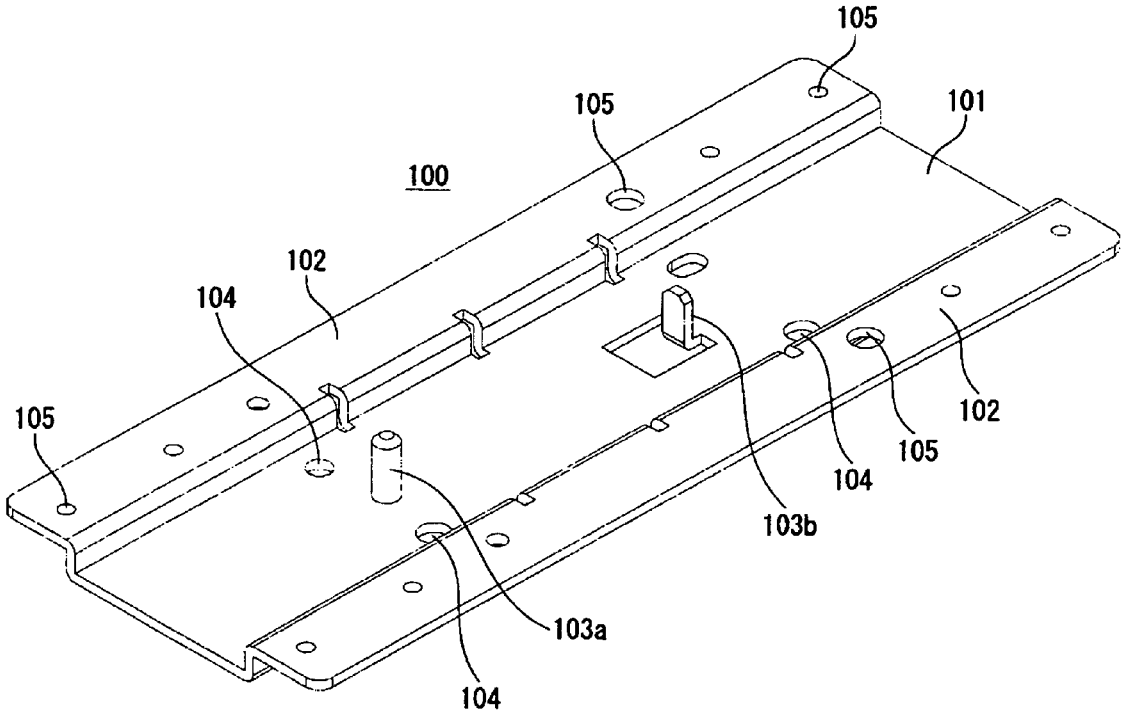
FIG. 11 is an enlarged perspective view of a main portion of an ink jet recording apparatus according to a fourth embodiment of the present invention.

FIG. 11 is an enlarged perspective view showing a deformation absorbing member according to a fourth embodiment of the present invention. In this embodiment, a deformation absorbing member 100 is composed of a board portion 101 to be fixed to the leg portion side and flexible step portions 102, each having an L-shaped cross section and formed in a step shape by bending each of ends on the right and left of the board portion, to be fixed to the ink jet recording apparatus main body side. The deformation absorbing member 100 has substantially the same construction as that of the third embodiment except that a dimension as a whole is longer. The board portion 101 is provided with positioning pins 103*a* and 103*b* formed upright on an upper surface thereof and bolt holes 104 formed therein, for fixation to the support portions

13. The positioning pin 103*a* is a columnar rigid pin. The positioning pin 103*b* is an elastic pin cut and raised form the board portion 101. The flexible step portion 102 having the L-shaped cross section is bent at each of the ends on the right and left of the board portion so as to have a predetermined step and formed such that an upper surface portion thereof is in parallel with the board portion 101. Further, in the upper surface portion of the flexible step portion 102 having the L-shaped cross-section, there is formed bolt holes 105 for fixation to the ink jet recording apparatus main body 11.

Note that, in the embodiments described above, each of the board portions 32, 91, and 101 is attached to the leg portion 12 side, and each of the flexible cut and raised portion 33 and the flexible step portions 92 and 102 having the L-shaped cross section is attached to the ink jet recording apparatus main body 11 side. On the other hand, however, it is also possible to attach the board portion 32, 91, or 101 to the ink jet recording main body 11 side, and the flexible cut and raised portion 33 or the flexible step portion 92 or 102 having the L-shaped cross section to the leg portion 12 side.

Further, even with an ink jet recording apparatus having the ink jet recording apparatus main body and the leg portion formed in a single body, as long as the deformation absorbing member is interposed in advance in the joint portion between the ink jet recording apparatus main body and the leg portion, it is possible to obtain the same effect.

What is claimed is:

1. An ink jet recording apparatus, comprising: an ink jet recording apparatus main body;

a leg portion; and a deformation absorbing member interposed in a joint portion between the ink jet recording apparatus main body and the leg portion, the deformation absorbing member comprising a rectangular board portion fixed to one of the ink jet recording apparatus main body and the leg portion, and flexible cut and raised portions, each of which is cut and raised from each of four corners of the board portion and has an L-shaped cross section, fixed to the other one of the ink jet recording apparatus main body and the leg portion.

2. The ink jet recording apparatus according to claim 1, wherein the deformation absorbing member has a positioning pin on a surface opposed to the ink jet recording apparatus main body.

3. The ink jet recording apparatus according to claim 1, wherein the deformation absorbing member constitutes a spring member made of SUS 301, SUS 303, or SECC.

4. An ink jet recording apparatus, comprising: an ink jet recording apparatus main body; a leg portion that supports the ink jet recording apparatus main body on a floor surface; and two spaced-apart deformable absorbing members interposed between the ink jet recording apparatus main body and the leg portion, each deformable absorbing member having a plate portion fixed to one of the ink jet recording apparatus main body and the leg portion, and a plurality of flexible portions that are connected to the plate portion and fixed to the other one of the ink jet recording apparatus main body and the leg portion and that are flexible in a vertical direction to absorb uneven reaction forces exerted on the leg portion due to irregularities in the floor surface thereby leveling the ink jet recording apparatus main body, the flexible portions comprising flexible cut and raised portions of the plate portion and having an L-shaped cross section.

5. An ink jet recording apparatus according to claim 4; wherein the plate portion has a rectangular shape, and the flexible cut and raised portions are respectively formed at each of four corners of the plate portion.

* * * * *